US005842359A

United States Patent [19]

Longueira

[11] Patent Number: 5,842,359

[45] Date of Patent: Dec. 1, 1998

[54] ANTI-THEFT AUXILIARY LOCK FOR VEHICLES

[76] Inventor: Christopher F. Longueira, 222 Cleveland Ave., Hasbrouck Heights, N.J. 07604

[21] Appl. No.: 906,864

[22] Filed: Aug. 6, 1997

[51] Int. Cl.[6] ..... E05B 73/00

[52] U.S. Cl. ..... 70/14; 70/237; 292/288

[58] Field of Search ..... 70/14, 30, 49, 70/237, 238; 292/288–292, DIG. 69

[56] References Cited

U.S. PATENT DOCUMENTS

| | | | |
|---|---|---|---|
| D. 317,111 | 5/1991 | Johns | D8/344 |
| D. 319,964 | 9/1991 | Johns | D8/344 |
| 1,772,252 | 8/1930 | Henry | 70/85 X |
| 2,851,870 | 9/1958 | Eckel | 70/101 |
| 3,416,333 | 12/1968 | Weingart | 70/14 |
| 4,326,394 | 4/1982 | Stein | 70/14 |
| 4,506,527 | 3/1985 | Grill | 70/14 |
| 4,938,041 | 7/1990 | O'Gara | 70/95 |
| 4,964,662 | 10/1990 | O'Leary et al. | 292/295 |
| 5,165,743 | 11/1992 | Zock | 292/288 |
| 5,325,685 | 7/1994 | Frank | 70/14 |
| 5,369,970 | 12/1994 | Voiculescu et al. | 70/14 X |
| 5,388,876 | 2/1995 | Saincome | 292/288 X |
| 5,517,835 | 5/1996 | Smith | 70/14 |
| 5,542,723 | 8/1996 | Scharf | 292/289 |
| 5,582,046 | 12/1996 | Baumwoll et al. | 70/237 |

*Primary Examiner*—Suzanne Dino Barrett
*Attorney, Agent, or Firm*—Arthur Jacob

[57] ABSTRACT

An anti-theft door lock for vehicles includes a base plate for straddling the vehicle door and the door frame when the vehicle door is closed, a cover plate for securement over the base plate, a slender locking cable for fitting between the vehicle door and the door frame and including a loop for reception over the striker which holds the vehicle door closed, a portion of the locking cable being captured between the base plate and the cover plate when the cover plate is closed over the base plate, with the locking cable securing the base plate to the vehicle, and a lock for locking the cover plate in place over the base plate and precluding unauthorized access to the captured portion of the locking cable.

11 Claims, 4 Drawing Sheets

FIG. 1
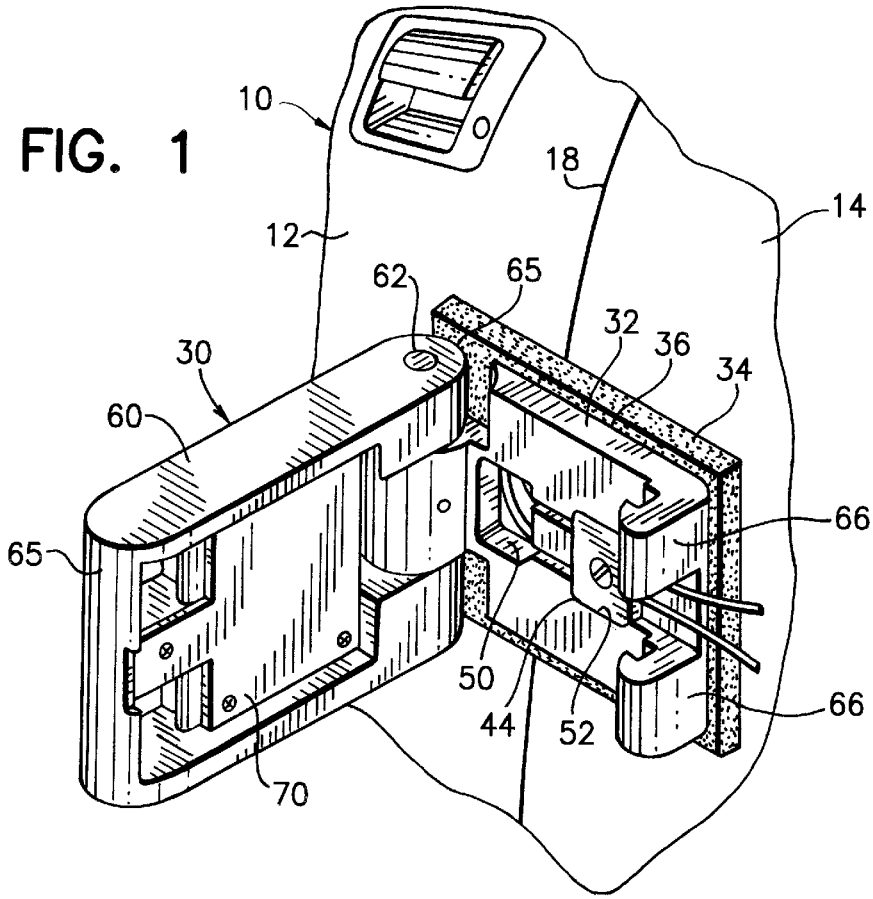
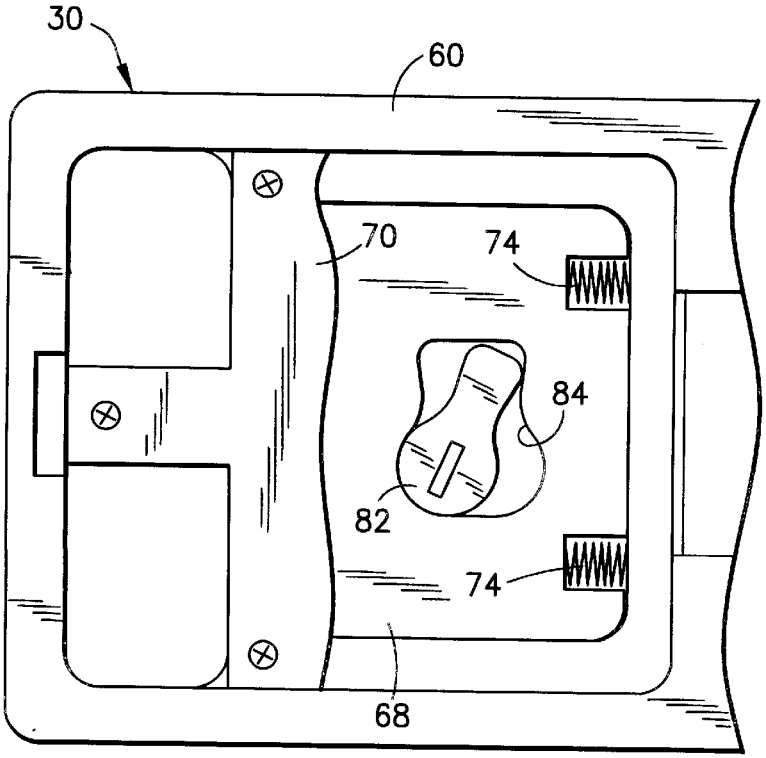
FIG. 6

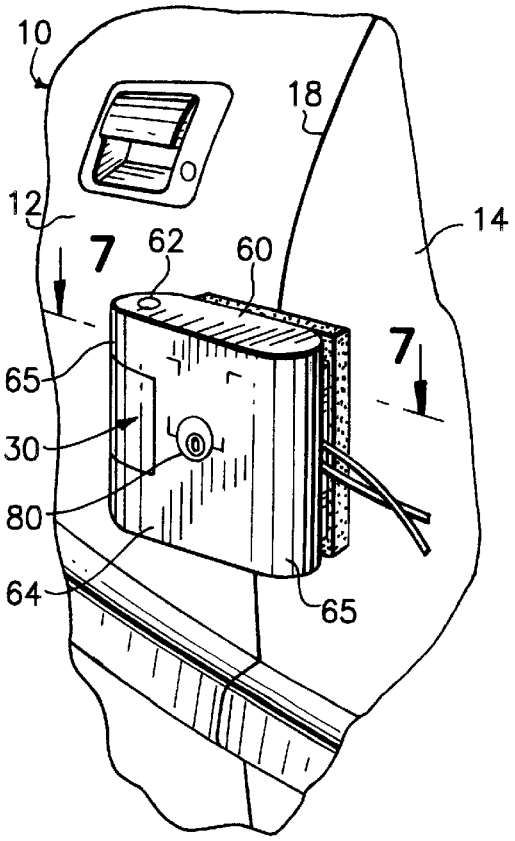
FIG. 2
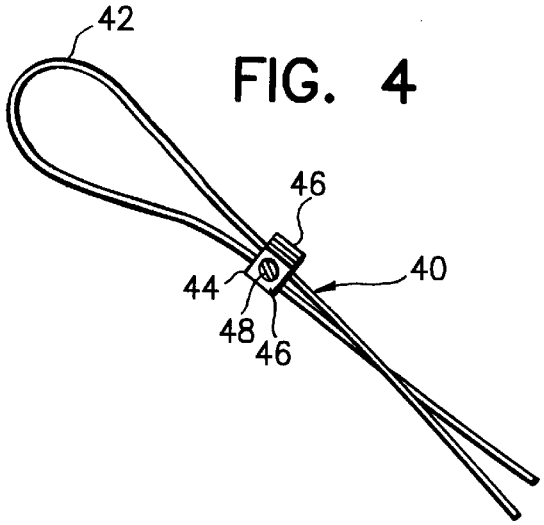
FIG. 4
FIG. 3
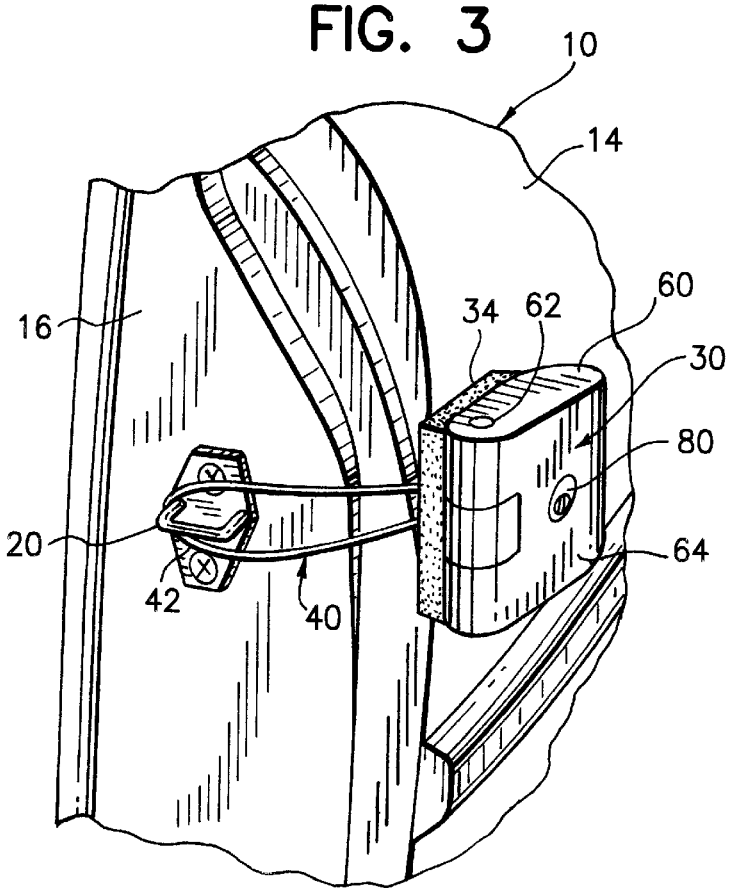

ANTI-THEFT AUXILIARY LOCK FOR VEHICLES

BACKGROUND OF THE INVENTION

1. Field of the Invention

The present invention relates generally to vehicle theft deterrents and pertains, more specifically, to an anti-theft auxiliary lock for the doors of vehicles, and especially automobiles.

2. Description of the Related Art

A wide variety of anti-theft locking devices are available for automobiles, providing diverse arrangements for the prevention of automobile theft. Among the more popular anti-theft devices are highly visible locking arrangements which are designed to prevent the operation of the automobile, thereby precluding theft of the vehicle. However, these arrangements do not prevent unauthorized entry into the vehicle and do not protect against the theft of articles within the vehicle, or vandalism of the interior of the vehicle.

BRIEF SUMMARY OF THE INVENTION

The present invention provides an auxiliary lock for vehicles which incorporates high visibility, for proven theft deterrence, and which secures the doors of the vehicle against unauthorized entry to combat not only theft of the vehicle, but the theft of articles within the vehicle and vandalism of the interior of the vehicle itself. As such, the present invention attains several objects and advantages, some of which are summarized as follows: Enables the securement of vehicle doors against unauthorized entry into the vehicle, thereby deterring theft of the vehicle, while protecting against the theft of articles within the vehicle and against vandalism of the vehicle interior; provides an additional highly visible and massive anti-theft device for deterring a thief; enables the use of a heavy-duty security lock, such as a cylinder lock, for establishing maximum security in an anti-theft arrangement for vehicles which utilizes a minimum number of moving parts; provides versatility and ease of adjustment for fitting to a wide variety of vehicles; enables ease of locking and unlocking so as to encourage widespread use; can be keyed readily for operation with a key common to other maximum security locks for increased ease of use, thereby encouraging frequent use; provides a configuration and arrangement which is exceptionally difficult to defeat, thereby enabling enhanced security; is resistant to weather and the elements, as well as being exceptionally rugged for withstanding a high degree of abuse and enabling exemplary performance over a long service life.

The above objects and advantages, as well as further objects and advantages, are attained by the present invention which may be described briefly as an anti-theft door lock for vehicles in which a vehicle door is secured in a closed position within a door frame by means of a striker projecting from the door frame, the striker being aligned with a parting line between the vehicle door and the door frame, the anti-theft lock comprising: a base plate for straddling the vehicle door and the door frame, the base plate having an opening for registration with the parting line adjacent the striker; a cover plate for securement over the base plate, the cover plate including a cover portion for overlying a corresponding portion of the base plate; a locking cable, the locking cable being slender for fitting between the vehicle door and the door frame, and including an anchoring portion for anchoring the locking cable to the striker; a first capturing element on the locking cable and spaced from the anchoring portion for passing through the opening in the base plate when the anchoring portion is anchored to the striker; a second capturing element adjacent the opening in the base plate, the second capturing element being complementary to the first capturing element for cooperating with the first capturing element to selectively detachably capture a further portion of the locking cable between the cover portion of the cover plate and the corresponding portion of the base plate, and securing the base plate in place straddling the parting line between the vehicle door and the door frame when the cover plate is secured over the base plate; and a lock for locking the cover plate in place over the base plate and precluding unauthorized access to the first and second capturing elements and the anchoring portion of the locking cable so as to maintain the base plate in place straddling the parting line between the vehicle door and the door frame and secure the vehicle door in the closed position against unauthorized opening.

DESCRIPTION OF THE SEVERAL VIEWS OF THE DRAWING

The invention will be understood more fully, while still further objects and advantages will become apparent, in the following detailed description of a preferred embodiment of the invention illustrated in the accompanying drawing, in which:

FIG. 1 is a pictorial perspective view showing an anti-theft auxiliary lock constructed in accordance with the present invention, about to be locked in place on a vehicle;

FIG. 2 is a pictorial perspective view similar to FIG. 1 and showing the lock locked in place;

FIG. 3 is a pictorial perspective view, partially broken away to show the manner in which the lock is fixed in place;

FIG. 4 is a pictorial perspective view of a component part of the lock;

FIG. 6 is a fragmentary front elevational view of a portion of the lock as depicted in FIG. 5, but with component parts in another operating position;

DETAILED DESCRIPTION OF THE INVENTION

Figure 5:
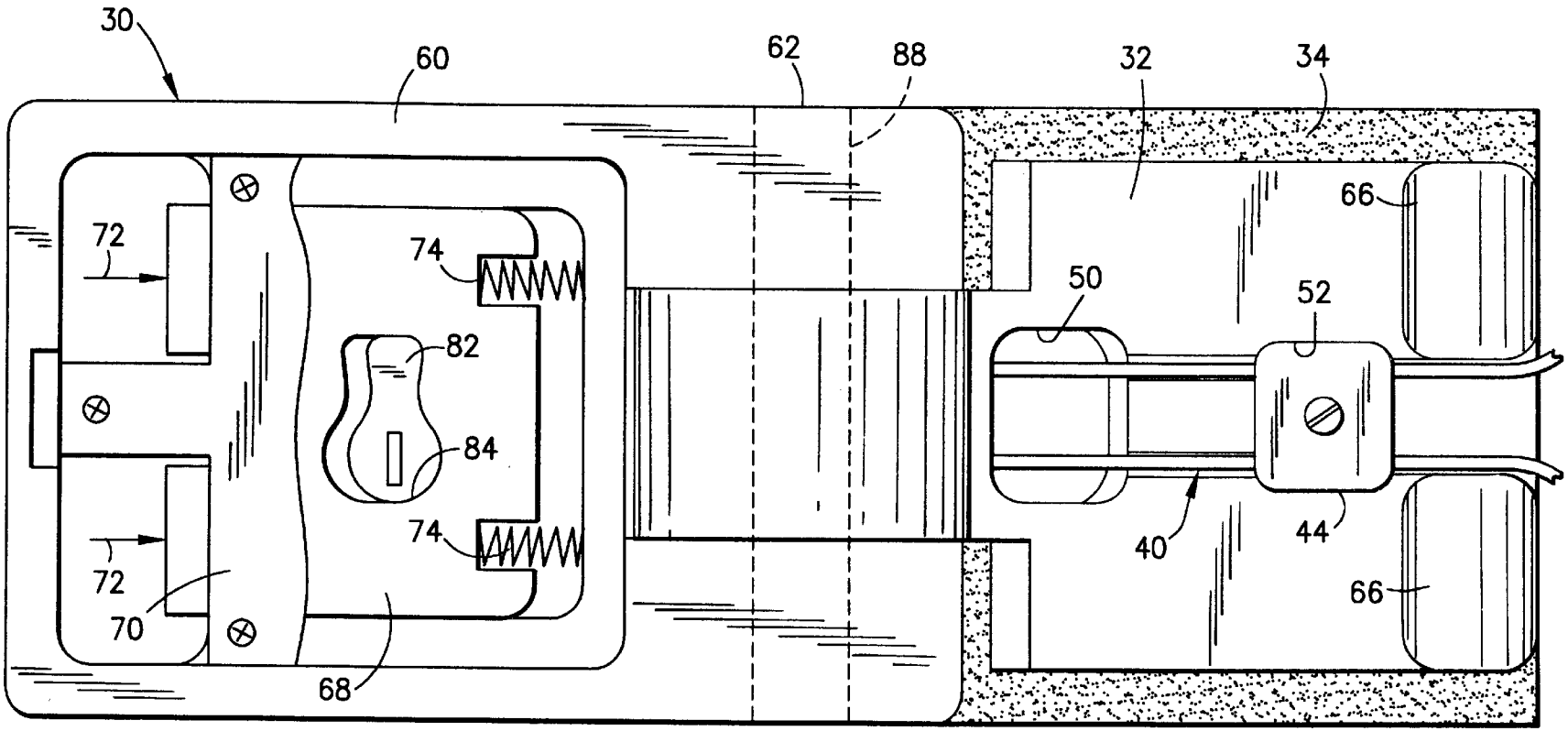
FIG. 5 is a front elevational view of the lock in an open configuration for viewing internal component parts.
Figure 7:
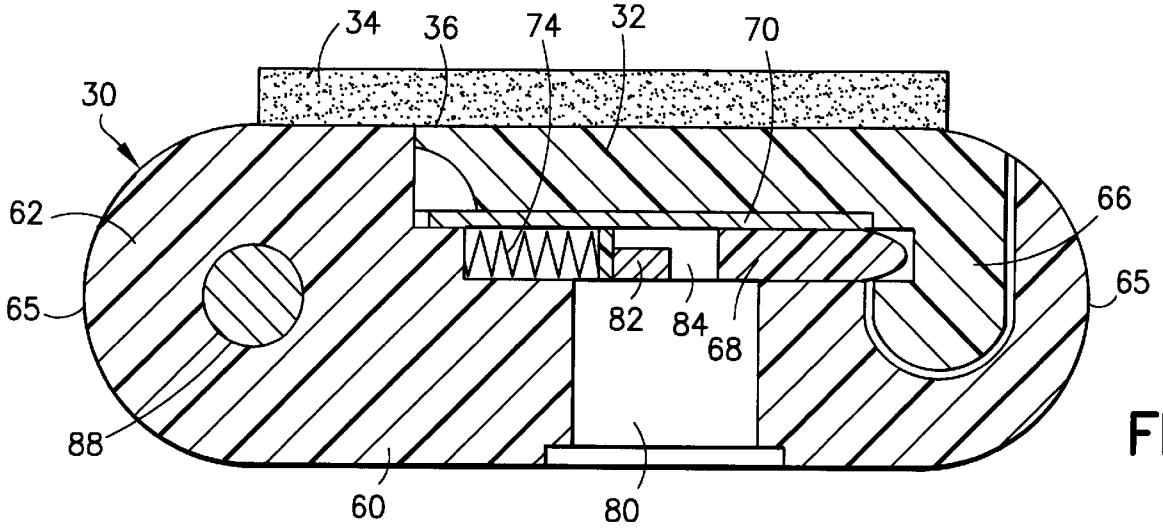
FIG. 7 is an enlarged cross-sectional view taken along line 7—7 of FIG. 2.

Referring now to the drawing, and especially to FIGS. 1 through 4 thereof, a vehicle 10 includes a door 12 which is to be secured closed within body 14 of the vehicle 10, the door 12 being located and hinged within a door frame 16 in the body 14 and being separated from the door frame 16 by a parting line 18. In order to maintain the door 12 closed, a striker 20 projects from the door frame 16 and is engaged by a door latch (not shown), all as is well known in current automobile construction.

An anti-theft auxiliary lock constructed in accordance with the present invention is illustrated at 30 and is seen to include a base plate 32 for straddling the parting line 18 between the door 12 and the door frame 16 of the vehicle 10, as seen in FIGS. 1 and 2. A resilient pad 34 is affixed to a basal surface 36 of the base plate 32 so as to protect the surface of the door 12 and the body 14 adjacent the door 12 against scratching or other damage which might occur as a result of the base plate 32 being urged against the door 12 and the body 14. A locking cable 40, best seen in FIG. 4, includes an anchoring portion in the form of a loop 42 and carries a first capturing element in the form of a fitting 44 affixed to the cable 40. Fitting 44 preferably has a rectangular plan configuration and includes clamping elements 46 bridging the looped cable 40 and held together by a clamping screw 48 which, when tightened, draws the clamping elements 46 together and into clamping engagement with the locking cable 40.

The auxiliary lock 30 is secured in place as follows: The loop 42 of the locking cable 40 is placed over the striker 20, as illustrated in FIG. 3, while the door 12 is open, to anchor the locking cable 40 to the striker 20. Then the door 12 is closed, with the cable 40 protruding through the parting line 18, and the cable 40 and fitting 44 are pulled through an opening 50 in the base plate 32 of the lock 30, as seen in FIGS. 1 and 5. The cable 40 is pulled tight and the fitting 44 is seated within a second capturing element in the form of a recess 52 in the base plate 32, the recess 52 being complementary to the fitting 44 and located adjacent the opening 50 in the base plate 32 so that the fitting 44 is selectively detachably captured in the recess 52 for a high degree of security with ease of use. It is noted that the location of the fitting 44 along the cable 40 is selectively adjustable by loosening the clamping screw 48, pulling the cable 40 through the fitting 44, and then tightening the clamping screw 48. In this manner, the lock 30 is secured tightly against the vehicle 10, with the base plate 32 straddling the parting line 18 so as to preclude opening of the door 12. The employment of the relatively slender cable 40, selectively adjustable to any desired length, enables the cable 40 to be threaded between the door and the door frame of a wide variety of vehicles, rendering the auxiliary lock 30 exceptionally versatile and universally adaptable.

A cover plate 60 is hinged to the base plate 32 by means of a hinge 62 for swinging movement between an open position, as seen in FIG. 1, and a closed position, as seen in FIG. 2. The above installation of the lock 30 against the vehicle 10 is accomplished with the cover plate 60 open, as shown. Once the base plate 32 is firmly secured to the vehicle 10, straddling the parting line 18 as described above, the cover plate 60 is moved to the closed position where a cover portion 64 of the cover plate 60 overlies the recess 52 and the fitting 44 to capture the fitting 44 within the recess 52 and preclude access to the fitting 44. The cable 40 and the fitting 44 no longer are accessible, both from outside and inside the vehicle 10, and the closed door 12 of the vehicle 10 is secure. Cover plate 60 includes ends which are rounded, as at rounded end surfaces 65, so as to render the cover member 60 much more difficult to engage with various prying tools.

Figure 8:
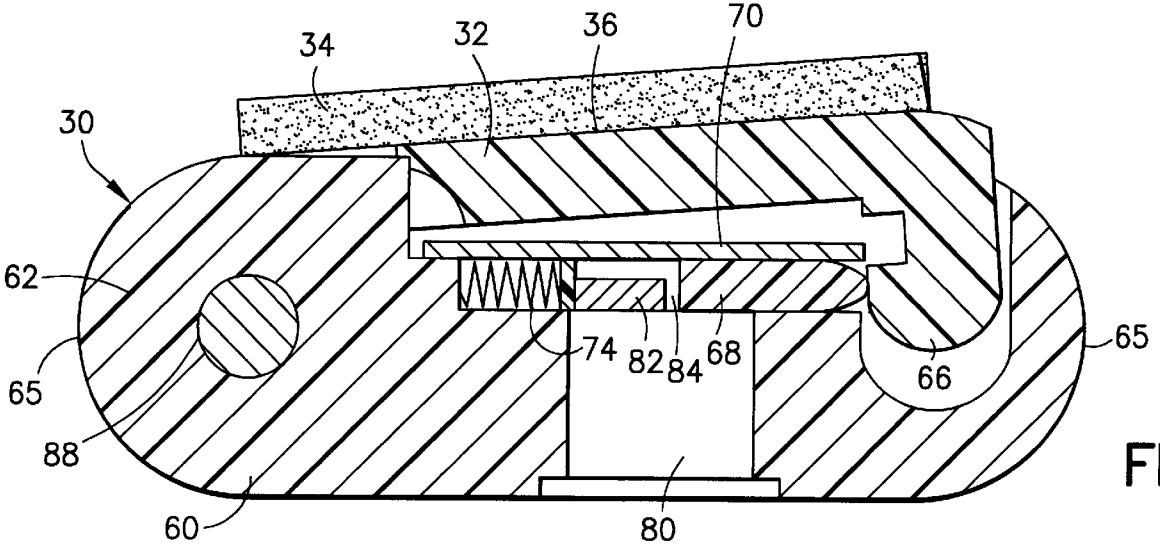
FIG. 8 is a cross-sectional view similar to FIG. 7, but with component parts in another operating position.

As best seen in FIGS. 5 through 8, as well as in FIG. 1, base plate 32 includes striker elements 66 projecting outwardly from the base plate 32, and cover plate 60 carries a latching element 68 mounted for sliding movement along the cover plate 60, behind a shield plate 70, in the directions indicated by arrows 72. Latching element 68 is biased toward a latched position, illustrated in FIGS. 5 and 7, by biasing springs 74, within which position the latching element 68 engages the striker elements 66 to secure the cover plate 60 in the closed position. A heavy-duty cylinder lock 80 is mounted in the cover plate 60 and is coupled to the latching element 68 by means of a cam 82 and follower 84 arrangement, the cam 82 being carried for movement by the cylinder lock 80 and the follower 84 being formed in the latching element 68. Actuation of the cylinder lock 80 moves the latching element 68 against the bias of biasing springs 74 and out of latching engagement with the striker elements 66, as seen in FIG. 8, enabling authorized opening of the cover plate 60 and removal of the auxiliary lock 30. Cylinder lock 80 is of the same type utilized for maximum security in homes and offices and the like and conveniently may be keyed for operation with a key common to the user's home or office locks, thereby providing a high degree of convenience with maximum security. The overall configuration of auxiliary lock 30 is generally symmetrical so that the auxiliary lock 30 readily is placed at any location on a vehicle.

The arrangement of component parts in auxiliary lock 30 enables the use of massive amounts of exceptionally high strength materials. Thus, the base plate 32 and the cover plate 60 preferably are constructed of steel or another relatively high strength alloy. Hinge 62 includes a relatively large diameter hinge pin 88 of high strength material. Cable 40 is constructed of stranded steel for exceptional strength and minimal diameter, and is coated with a synthetic polymeric material to protect the door 12 and the body 14 of the vehicle 10. All in all, auxiliary lock 30 presents a massive structure which not only provides a high degree of strength and protection, but which presents a massive and impenetrable appearance for deterring theft.

It will be seen that the present invention attains the several objects and advantages summarized above, namely: Enables the securement of vehicle doors against unauthorized entry into the vehicle, thereby deterring theft of the vehicle, while protecting against the theft of articles within the vehicle and against vandalism of the vehicle interior; provides an additional highly visible and massive anti-theft device for deterring a thief; enables the use of a heavy-duty security lock, such as a cylinder lock, for establishing maximum security in an anti-theft arrangement for vehicles which utilizes a minimum number of moving parts; provides versatility and ease of adjustment for fitting to a wide variety of vehicles; enables ease of locking and unlocking so as to encourage widespread use; can be keyed readily for operation with a key common to other maximum security locks for increased ease of use, thereby encouraging frequent use; provides a configuration and arrangement which is exceptionally difficult to defeat, thereby enabling enhanced security; is resistant to weather and the elements, as well as being exceptionally rugged for withstanding a high degree of abuse and enabling exemplary performance over a long service life.

It is to be understood that the above detailed description of a preferred embodiment of the invention is provided by way of example only. Various details of design and construction may be modified without departing from the true spirit and scope of the present invention, as set forth in the appended claims.

The claimed embodiments of the invention in which an exclusive property of privilege is claimed are defined as follows:

1. An anti-theft door lock for vehicles in which a vehicle door is secured in a closed position within a door frame by means of a striker projecting from the door frame, the striker being aligned with a parting line between the vehicle door and the door frame, the anti-theft lock comprising:

a base plate for straddling the vehicle door and the door frame, the base plate having an opening for registration with the parting line adjacent the striker;

a cover plate for securement over the base plate, the cover plate including a cover portion for overlying a corresponding portion of the base plate;

a locking cable, the locking cable being slender for fitting between the vehicle door and the door frame, and including an anchoring portion for anchoring the locking cable to the striker;

a first capturing element on the locking cable and spaced from the anchoring portion for passing through the opening in the base plate when the anchoring portion is anchored to the striker;

a second capturing element adjacent the opening in the base plate, the second capturing element being complementary to the first capturing element for cooperating with the first capturing element to selectively detachably capture a further portion of the locking cable between the cover portion of the cover plate and the corresponding portion of the base plate, and securing the base plate in place straddling the parting line between the vehicle door and the door frame when the cover plate is secured over the base plate; and a lock for locking the cover plate in place over the base plate and precluding unauthorized access to the first and second capturing elements and the anchoring portion of the locking cable so as to maintain the base plate in place straddling the parting line between the vehicle door and the door frame and secure the vehicle door in the closed position against unauthorized opening.

2. The invention of claim 1 wherein the anchoring portion includes a loop in the locking cable for reception over the striker to anchor the locking cable to the striker.

3. The invention of claim 2 wherein:

the first capturing element comprises a fitting affixed to the locking cable and spaced from the loop for passing through the opening in the base plate when the loop is placed over the striker; and the second capturing element comprises a recess in the base plate adjacent the opening, the recess being essentially complementary to the fitting for receiving the fitting within the recess when the base plate straddles the parting line and the looped end of the locking cable is placed over the striker.

4. The invention of claim 1 wherein the lock comprises a cylinder lock.

5. The invention of claim 4 wherein the cylinder lock is carried by the cover plate.

6. The invention of claim 1 including a hinge connecting the cover plate with the base plate for swinging movement of the cover plate relative to the base plate between an open position, wherein the first and second capturing elements are exposed for selective engagement and disengagement, and a closed position wherein the cover plate precludes access to the first and second capturing elements.

7. The invention of claim 6 wherein:

the anchoring portion includes a loop in the locking cable for reception over the striker to anchor the locking cable to the striker;

the first capturing element comprises a fitting affixed to the locking cable and spaced from the loop for passing through the opening in the base plate when the loop is placed over the striker; and the second capturing element comprises a recess in the base plate adjacent the opening, the recess being essentially complementary to the fitting for receiving the fitting within the recess when the base plate straddles the parting line and the looped end of the locking cable is placed over the striker.

8. The invention of claim 7 including a latch for latching the cover plate in the closed position on the base plate.

9. The invention of claim 8 wherein the lock comprises a cylinder lock.

10. The invention of claim 9 wherein the cylinder lock is carried by the cover plate.

11. The invention of claim 10 including a resilient pad on the base plate for engagement with the vehicle when the base plate straddles the parting line between the vehicle door and the door frame.

* * * * *